US011312398B2

(12) United States Patent
Grip et al.

(10) Patent No.: US 11,312,398 B2
(45) Date of Patent: Apr. 26, 2022

(54) ACTIVE CONTROL DEFLECTION NEUTRALIZER

(71) Applicant: The Boeing Company, Chicago, IL (US)

(72) Inventors: Robert Erik Grip, Rancho Palos Verdes, CA (US); Steven Fulton Griffin, Kihei, HI (US)

(73) Assignee: The Boeing Company, Chicago, IL (US)

( * ) Notice: Subject to any disclaimer, the term of this patent is extended or adjusted under 35 U.S.C. 154(b) by 758 days.

(21) Appl. No.: 16/262,642

(22) Filed: Jan. 30, 2019

(65) Prior Publication Data

US 2020/0239037 A1 Jul. 30, 2020

(51) Int. Cl.

| | |
|---|---|
| ***B61B 13/08*** | (2006.01) |
| ***E01B 35/12*** | (2006.01) |
| ***B61B 5/00*** | (2006.01) |

(52) U.S. Cl.

CPC ..... *B61B 13/08* (2013.01); *B61B 5/00* (2013.01); *E01B 35/12* (2013.01)

(58) Field of Classification Search

CPC ..... B61B 13/08; B61B 5/00; E01B 35/12

See application file for complete search history.

(56) References Cited

U.S. PATENT DOCUMENTS

| | | | | |
|---|---|---|---|---|
| 4,042,190 | A * | 8/1977 | Ueno | B65G 51/06 406/185 |
| 4,212,247 | A * | 7/1980 | Lusk | B60B 19/14 104/108 |
| 5,653,173 | A * | 8/1997 | Fischer | B60L 13/10 104/118 |
| 8,261,669 | B2 * | 9/2012 | Grundlingh | E21F 13/061 104/138.2 |
| 8,950,338 | B2 * | 2/2015 | Early | F16L 55/34 104/138.2 |
| 11,091,175 | B2 * | 8/2021 | Grip | F04B 49/065 |
| 2004/0244635 | A1 * | 12/2004 | Schlienger | B61B 13/122 104/138.1 |
| 2018/0186389 | A1 * | 7/2018 | Hosseini | B61F 11/00 |
| 2018/0281820 | A1 * | 10/2018 | Grip | B61B 13/10 |
| 2019/0210471 | A1 * | 7/2019 | Janzen | B60L 13/04 |
| 2020/0122748 | A1 * | 4/2020 | Grip | F04B 49/065 |
| 2020/0239037 | A1 * | 7/2020 | Grip | B61B 13/10 |
| 2021/0340713 | A1 * | 11/2021 | Zhu | B61B 5/00 |

* cited by examiner

*Primary Examiner* — Jason C Smith

(74) *Attorney, Agent, or Firm* — Yee & Associates, P.C.

(57) ABSTRACT

Neutralizing deflection in a transportation system comprising connecting a number of support structures to ground. A tube is coupled to the support structures via a number of actuators, wherein the tube defines an interior enclosure through which a vehicle can travel. Utilizing a number of sensors, directional displacement of the support structures can be sensed, and the actuators are controller to counter the sensed displacement of the support structures by producing a directionally-opposite displacement of the tube relative to the support structures.

20 Claims, 15 Drawing Sheets

ACTIVE CONTROL DEFLECTION NEUTRALIZER

BACKGROUND INFORMATION

1. Field

The present disclosure relates generally to high speed terrestrial transportation and, in particular, to maintaining stability of a vacuum tube vehicle under conditions of seismic disturbance.

2. Background

A mode of transportation has been investigated in which a vehicle travels through a tube near the surface of the earth at high speeds. The high speeds are enabled by a near frictionless propulsion/levitation system, such as magnetic levitation (Mag-Lev), that eliminates or greatly reduces rolling friction, and evacuating the tube of air so that aerodynamic drag is eliminated or greatly reduced.

Such a system can be underground or some distance above the surface of the earth, as shown in FIG. 2. The speeds at which the vehicles travel inside the tube can be as much as hundreds or even thousands of miles per hour. At such speeds, the tolerances for straightness and gentle curves of the tubes are critical, being more important as the maximum speeds are increased.

SUMMARY

In one illustrative embodiment a stabilization apparatus comprises a number of support structures configured to support a tube that defines an interior enclosure through which a vehicle can travel, wherein the support structures are connected to ground. A number of actuators are coupled to the support structures and connectable to the tube, being configured to displace the tube relative to the support structures. A number of sensors are configured to sense directional displacement of the number of support structures. Responsive to a determination of a sensed displacement by at least one sensor, a number of controllers in communication with the sensors and actuators are configured to cause the actuators to counter the sensed displacement of the support structures by producing a directionally-opposite displacement of the tube relative to the support structures.

In another illustrative embodiment a transportation system comprises a tube defining an interior enclosure through which a vehicle can travel. A number of support structures are configured to support the tube, wherein the support structures are connected to ground. A number of actuators coupling the tube to the support structures are configured to displace the tube relative to the support structure. A number of sensors are configured to sense directional displacement of the number of support structures. Responsive to a determination of a sensed displacement by at least one sensor a number of controllers in communication with the number of sensors and number of actuators are configured to cause the actuators to counter the sensed displacement of the support structures by producing a directionally-opposite displacement of the tube relative to the support structures.

In another illustrative embodiment a method of neutralizing deflection in a transportation system, the comprises connecting a number of support structures to ground and coupling a tube to the support structures via a number of actuators, wherein the tube defines an interior enclosure through which a vehicle can travel. Utilizing a number of sensors, directional displacement of the support structures is detected, and the actuators are controlled to counter the sensed displacement of the support structures by producing a directionally-opposite displacement of the tube relative to the support structures.

The features and functions can be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the illustrative embodiments are set forth in the appended claims. The illustrative embodiments, however, as well as a preferred mode of use, further objectives, and features thereof will best be understood by reference to the following detailed description of an illustrative embodiment of the present disclosure when read in conjunction with the accompanying drawings, wherein:

DETAILED DESCRIPTION

Figure 11:
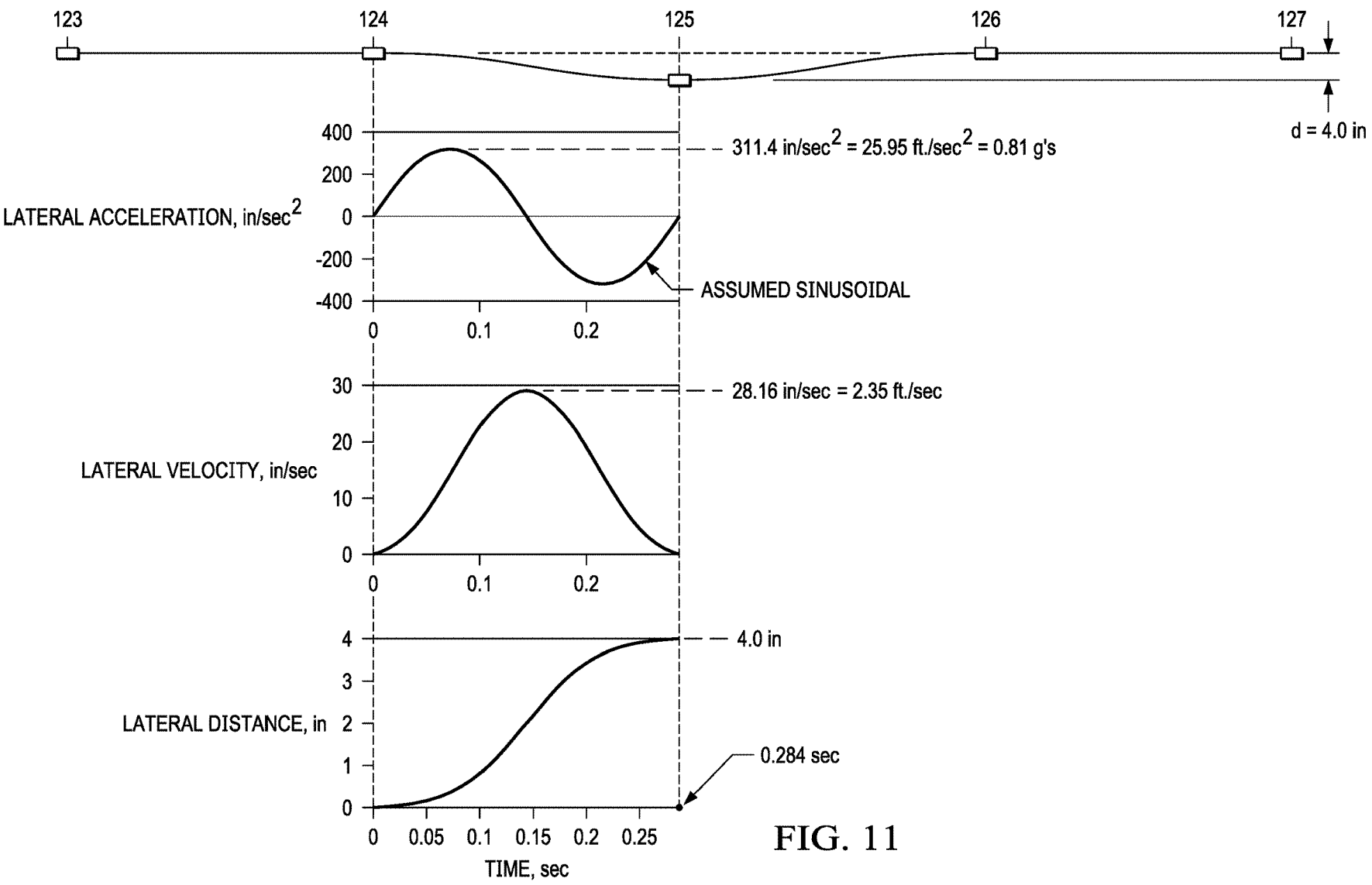
FIG. 11 illustrates an example of relative displacement and acceleration of a high-speed, vacuum tube vehicle in response to an earthquake acceleration.

The illustrative embodiments recognize and take into account one or more different considerations. For example, the illustrative embodiments recognize and take into account that as the speeds of high speed vacuum tube vehicles increases, the tolerances for straightness of the tubes become more critical. For example, if support structures for an above ground vehicle tube are spaced 250 feet apart, and the vehicle is traveling at 600 miles per hour, the vehicle will pass a support every 0.284 seconds. If a support is out of alignment by 4.0 inches, and the acceleration profile follows a sine profile, the vehicle will experience 0.81 g's, as shown in FIG. 11. This is a large and unacceptable amount of acceleration for passengers.

Illustrative embodiments also recognize and take into account that acceleration from seismic activity such as earthquakes results in similar amounts of ground motion and corresponding lateral displacement of support structures describe above. Such levels of acceleration and displacement are not acceptable for passengers of the vacuum tube vehicle.

Several approaches have been proposed to mitigate lateral displacement to protect passengers in a vacuum tube vehicle that is experiencing an earthquake event. However, these potential solutions have numerous drawbacks.

One approach would provide passengers with seat belts, full body harnesses, or special suits similar to fighter pilot "G suits" that can protect passengers from high accelerations. Although effective in providing a degree of safety to the passengers, the expense and inconvenience associated with this approach makes it unfeasible for commercial traffic.

Another approach is to construct the tubes to be very massive. Adding mass to a structure reduces the natural frequency of that structure. If the tubes are very massive, their natural frequency can be so low that they do not respond to the earthquake, similar to how very tall buildings can be less susceptible to earthquake ground motion because their natural period is longer than most of the frequency content of the earthquake. However, extremely massive structure is typically more expensive, and the support structures would be more expensive as well to be strong enough to support the massive tubes.

Conversely, if the support structures are made to be extremely flexible, the same effect can be obtained. For example, the supports can be designed as large springs, possibly with dampers. However, this solution would also be costly and heavy.

Illustrative embodiments provide a stabilization apparatus that comprises a number of support structures configured to support a tube that defines an interior enclosure through which a vehicle can travel, wherein the support structures are connected to ground. A number of actuators are coupled to the support structures and connectable to the tube. These actuators are configured to displace the tube relative to the support structures. A number of sensors in the stabilization system are configured to sense directional displacement of the number of support structures. Controllers in communication with the sensors and actuators are configured to cause the actuators to counter sensed displacement of the support structures by producing a directionally-opposite displacement of the tube relative to the support structures.

Illustrative embodiments use a finite element model to predict displacement of a support structure in advance of the vehicle's arrival at the support, providing feedforward control of the actuators.

Figure 1:
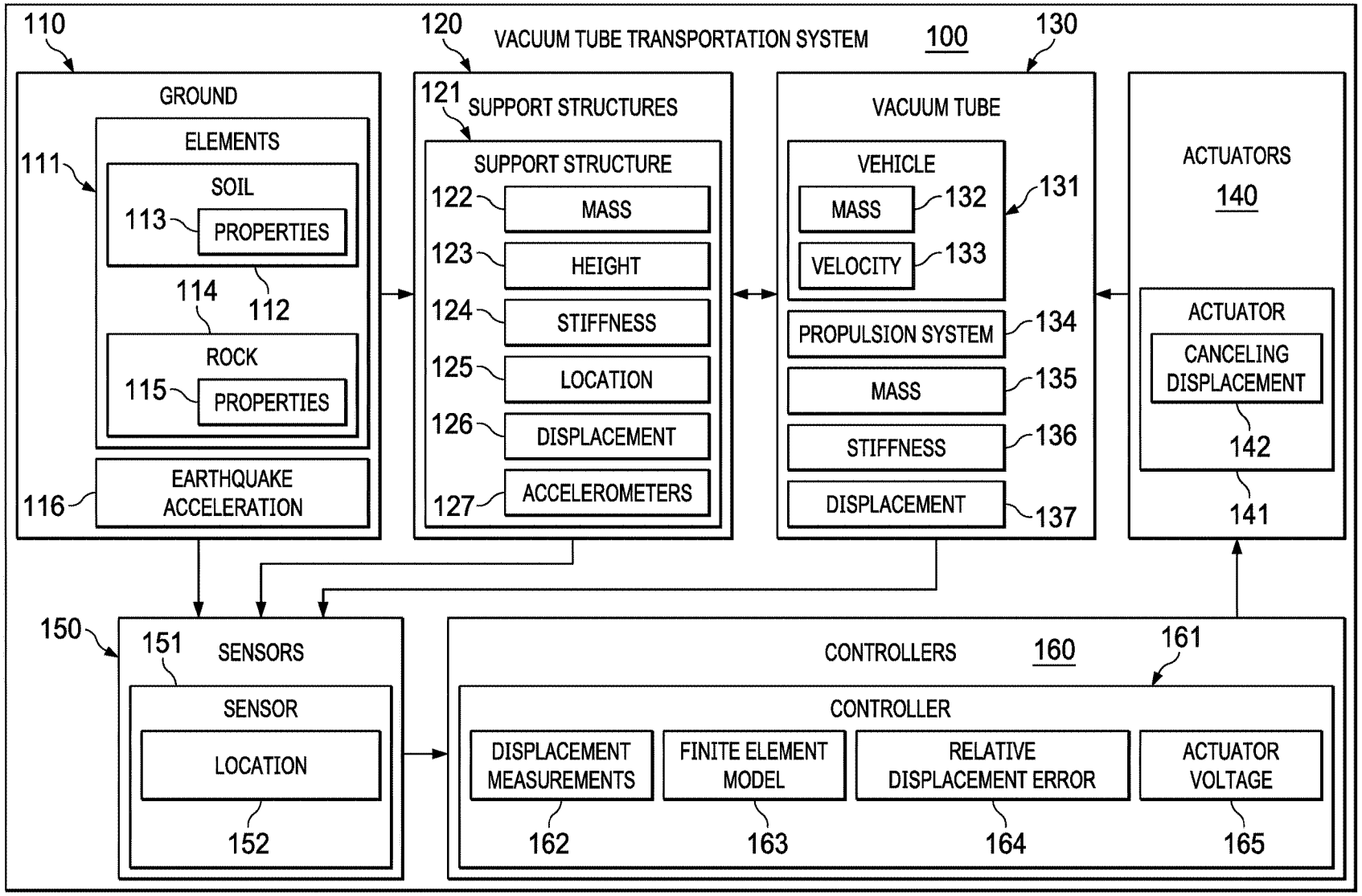
FIG. 1 is an illustration of a block diagram of a vacuum tube transportation system in accordance with an illustrative embodiment.

With reference now to the figures and, in particular, with reference to FIG. 1, an illustration of a block diagram of a vacuum tube transportation system 100 is depicted in accordance with an illustrative embodiment.

In the illustrative embodiment, the transportation system 100 is built a distance above the surface of the earth. The ground 110 forms the foundation of the system and comprises elements 111, principally divided into soil 112 and rock 113. The soil 112 and rock 113 each possess physical properties 113, 115, respectively, which include density, water content, and stiffness that determine how they will react to and transmit an earthquake acceleration 116.

The properties 113, 115 of the soil 112 and rock 113 can be used to construct a finite element model (FEM) 163 used to control the actuators 140 that maintain stability of the vacuum tube 130 and vehicle 131 inside it.

A number of support structures 120 are anchored to the ground 110 and hold the vacuum tube 130 a distance over the surface of the earth. Each support structure 121 within number of support structures 120 has a specific location 125 along the length of the vacuum tube 130 in which the vehicle 131 travels. Each support structure 121 also has a height 123 that can be specific to the location 125 depending on ground elevation and the need to keep the tube 130 level along the route.

The support structure 121 has a mass 122 and stiffness 124 that influences its displacement 126 in response to earthquake acceleration 116 or other seismic activity. In the present example, support structure 121 includes a number of accelerometers 127 that can detect displacement of the support structure 121. These accelerometers 127 can provide displacement measurement information and operate as part of feedback control to stabilize the tube 130 and vehicle 131, which can serve as the primary mechanism of stability control or as a supplemental or backup system to a feedforward control system.

The vacuum tube 130 is evacuated of air to eliminate or minimize aerodynamic drag of the vehicle 131 moving through it. Like the support structures 120, the vacuum tube 130 has a mass 135 and stiffness 136 that will influence its relative displacement 137 in response to an earthquake acceleration 116, as well as in response to the actuators 140.

The vehicle 131 is propelled through the tube 130 by a frictionless or near frictionless propulsion system 134 such as magnetic levitation (Mag-Lev). The mass 135 of the vehicle 131 contributes to the combined momentary mass of the tube/vehicle complex as the vehicle 131 moves through the tube 130, which can affect the relative displacement of the tube 130 in response to earthquake acceleration 116.

Figure 7:
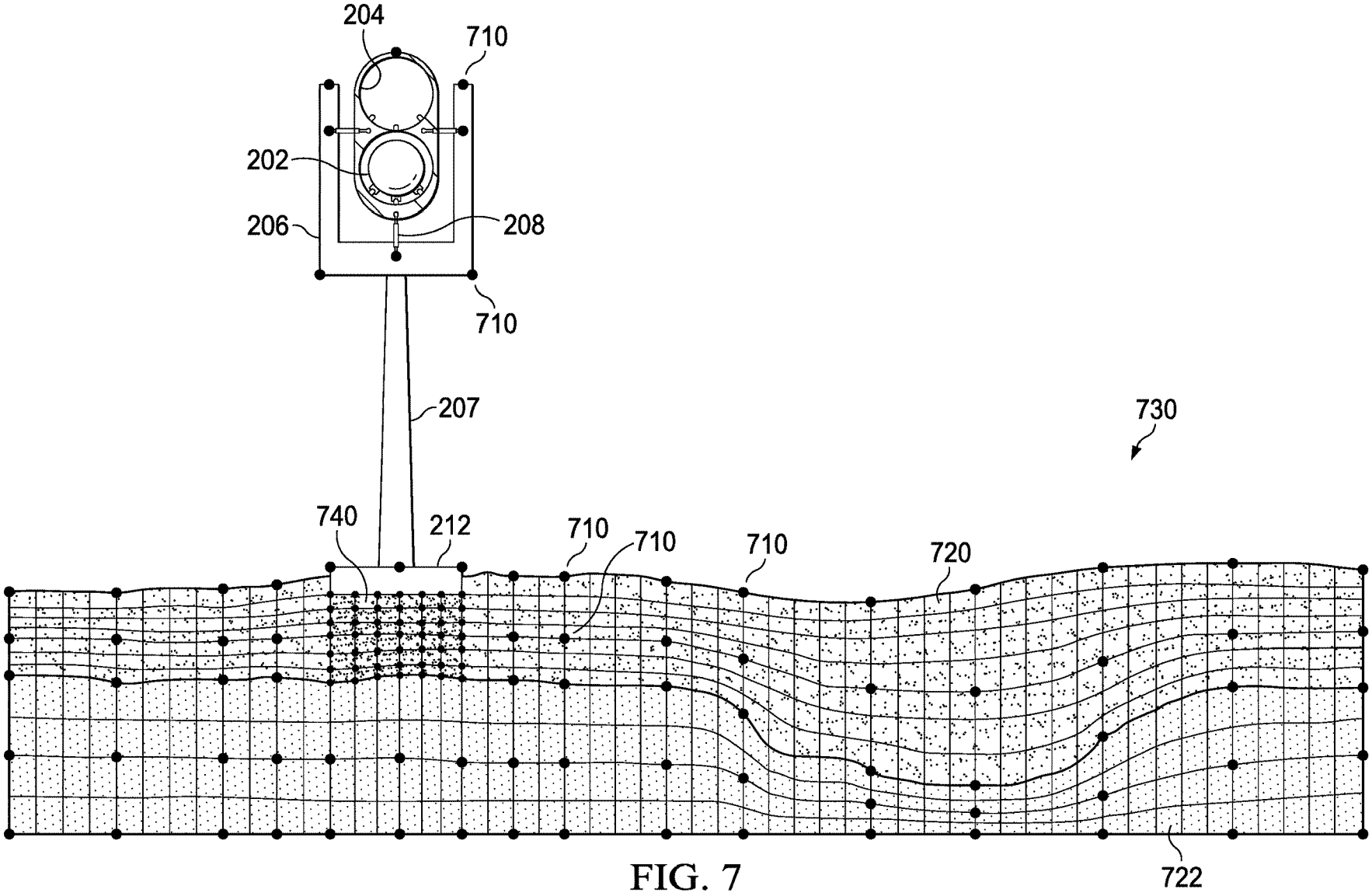
FIG. 7 illustrates a cross-section of ground in the vicinity of a support structure for the vacuum tube in accordance with an illustrative embodiment.

A number of sensors 150 are connected to the ground 110, support structures 120, and tube 130, which are configured to detect earthquake accelerations and displacement. Each sensor 151 among the number of sensors 150 has a location 152, which can be at different points along a support structure 121, on the tube 130, or at different points along or within the ground 110, either in the soil 112 or rock 115, as illustrated in FIG. 7.

Signals from the sensors 150 that include directional displacement measurement information are communicated to controllers 160 that control the actuators 140 to produce cancelling, directionally-opposite actuator displacement 142 of the tube 130 in response to detected displacement 126 of a support structure 121. Each controller 161 among controllers 160 receives displacement measurements 162 from sensors 150 that can be related to earthquake acceleration 116, displacement 126 of a support structure 121, and/or displacement 137 of the tube 130. The displacement measurements 162 can be provided by local sensors 150 co-located with the controller 161 and/or communicated from sensors 150 located up the line from the controller 161.

In the case when displacement measurements 162 are communicated to the controller 161 from up the line, these measurements can be input into a FEM 163 representing the support structure 121 that enables the controller 161 to predict the displacement 126 of a support structure 121 and tube 130 in advance of the vehicle's 131 arrival at that location 125. This allows the controller 161 to determine FEM predicted displacement with reference to sensor displacement measurements, and determine the requisite application of the actuator voltage 165 to the actuators 140 to produce the cancelling actuator displacement 142 to the tube 130 at the anticipated moment of the tube's displacement 137, thereby preventing the displacement 137 (or at least minimizing within system tolerances) rather than trying to cancel the displacement 137 after it has already begun, as in a feedback system.

The velocity 133 of the vehicle 131 contributes to the potential acceleration of the vehicle 131 in response to displacement of the tube 130 and support structures 120 from seismic activity. In the case of a feedforward control system, if the anticipated acceleration of the vehicle exceeds the ability of the actuators 140 to produce a completely cancelling directionally-opposite counter displacement of the tube 130 at a single support structure, such as support structure 121, the total cancelling displacement can be distributed over multiple support structures 120 in order to minimize the acceleration of the vehicle.

Accumulated sensor data from earthquake accelerations 116, support structure displacement 126, and tube displacement 137, as well as relative displacement errors 164 from the operation of the actuators 140 can be used to update and refine the FEM 163 representing the support structure 121.

Figure 2:
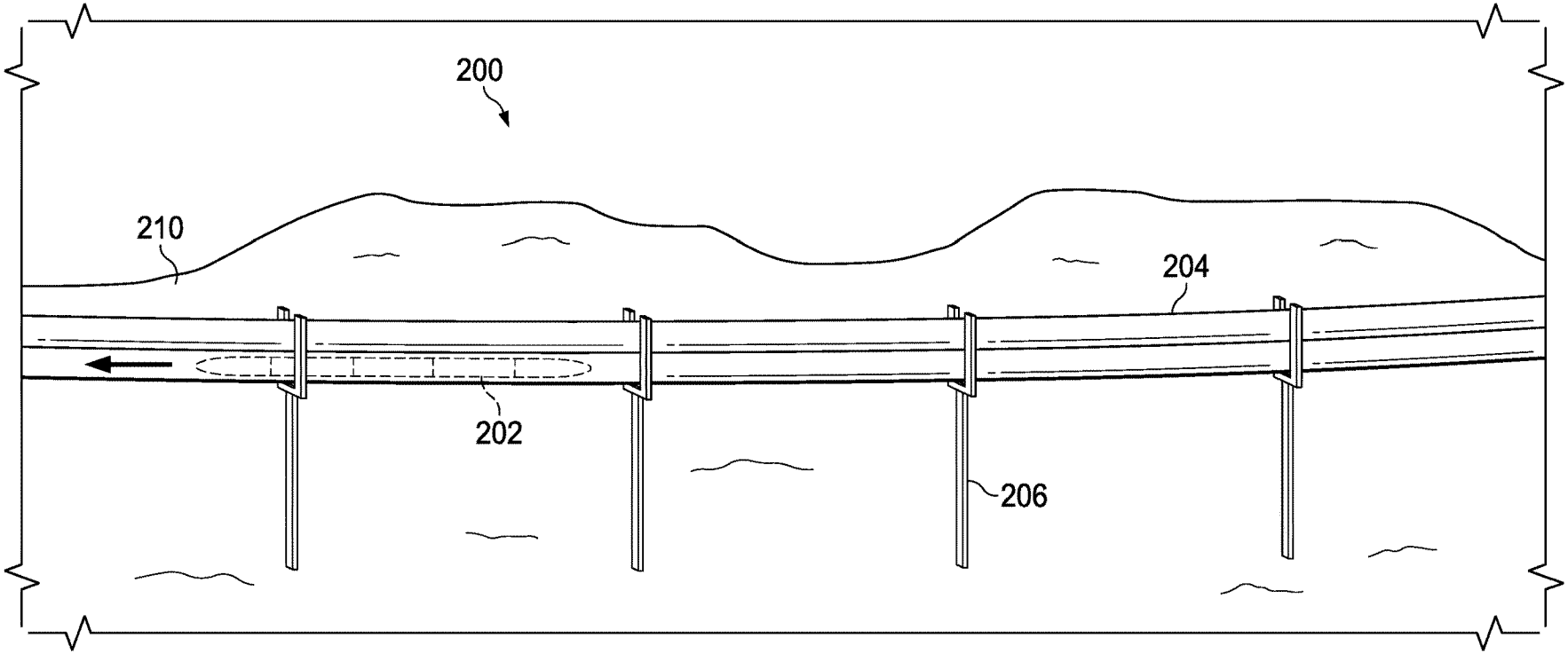
FIG. 2 is a pictorial illustration of a high speed vacuum tube transportation system in accordance with an illustrative embodiment.

With reference now to FIG. 2, a pictorial illustration of a high speed vacuum tube transportation system 200 is depicted in accordance with an illustrative embodiment. The high-speed, pressurized vehicle 202 is an example of vehicle 131 in FIG. 1 and moves through evacuated tubes 204 that define interior enclosures through which the vehicle 131 can travel, which is an example of the tube 130 in FIG. 1. The evacuated tubes 204 are held above the ground 210 by a number of support structures 206 that are connected to the ground 210 along the length of the tubes 204. The support structures are examples of support structures 120 in FIG. 1.

Figure 3:
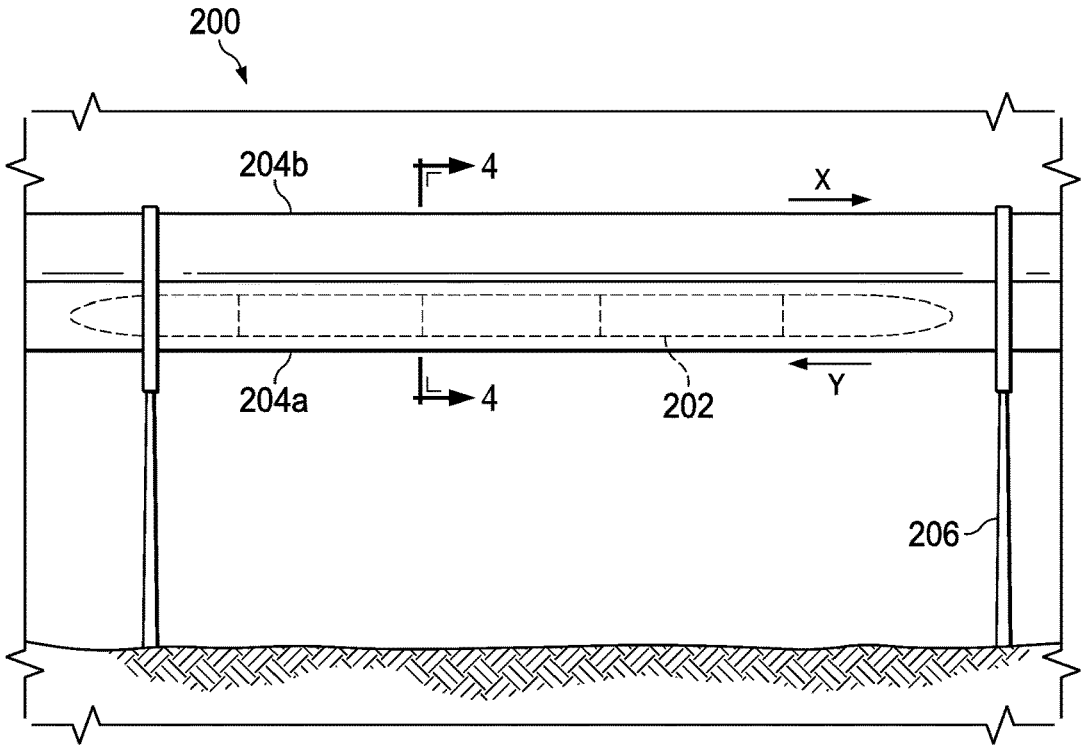
FIG. 3 is a close, side cross-section illustration of a vacuum tube transportation system in accordance with an illustrative embodiment.
Figure 4:
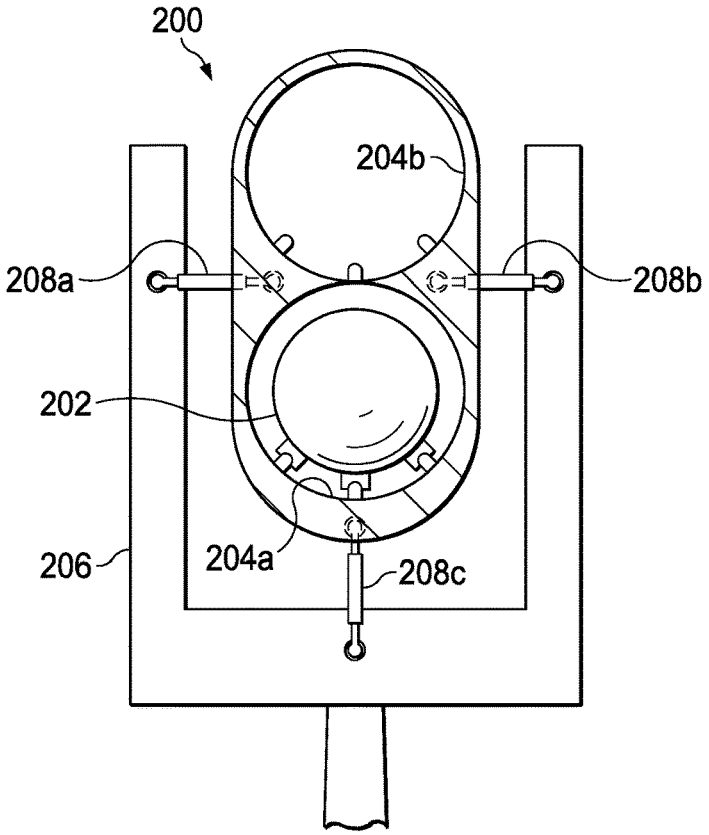
FIG. 4 illustrates the cross-section illustration of the vacuum tube transportation system across section A-A in accordance with an illustrative embodiment.
Figure 5:
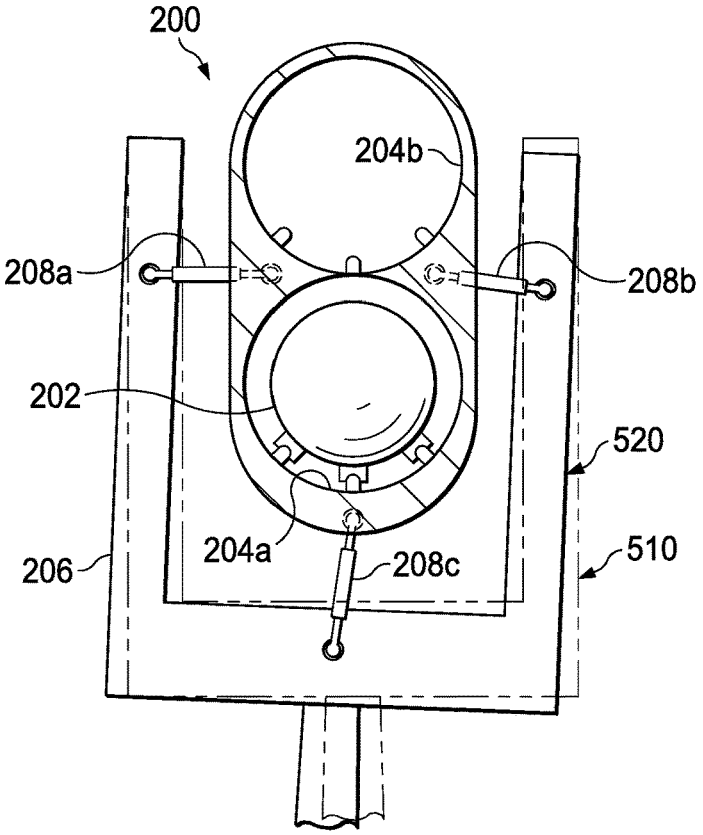
FIG. 5 illustrates the cross-section illustration of the vacuum tube transportation system across section A-A that shows deflection neutralization in accordance with an illustrative embodiment.

FIG. 3 is a close, side cross-section illustration of a vacuum tube transportation system 200 in accordance with an illustrative embodiment. FIG. 4 illustrates the cross-section illustration of the vacuum tube transportation system 200 across section A-A in accordance with an illustrative embodiment. FIG. 5 illustrates the cross-section illustration of the vacuum tube transportation system 200 across section A-A that shows deflection neutralization in accordance with an illustrative embodiment.

The illustrative embodiment shown in FIGS. 4 and 5 comprises a number of actuators 208*a*, 208*b*, 208*c* or other fast-responding mechanisms that couple the vacuum tubes 204*a*, 204*b* to the support structure 206. Actuators 208*a*, 208*b*, 208*c* are examples of actuators 140 in FIG. 1. This example arrangement includes three actuators at each support structure, two horizontal actuators 208*a*, 208*b* on either side of the tubes 204*a*, 204*b* and one vertical actuator 208*c* positioned beneath the tubes, where the lengths of each horizontal actuator 208*a* and the vertical actuator 208*b* can be controllably changed based on a signal or actuator voltage supplied to the actuators.

During an earthquake event, the location of the support structure 206 will change from its original location 510 to a new location 520 in space, as shown in FIG. 5. The location of the support structure will vary as a function of time as the earthquake event progresses.

Where the change in location of the support can be predicted, a signal can be provided, or an actuator voltage can be applied, to the three actuators 208*a*, 208*b*, 208*c* such that the controllably changed lengths of the actuators between the connection to the tubes 204*a*, 204*b* and the support structure 206 result in there being no movement of the tubes 204*a*, 204*b* during the earthquake event. The arrangement shown in FIGS. 4 and 5 show three actuators 208*a*, 208*b*, 208*c* connecting the tubes 204*a*, 204*b* with the support structure 206. This arrangement assumes that the tubes 204*a*, 204*b* have sufficient torsional stiffness to prevent them from rotating about their longitudinal axes.

Figure 6:
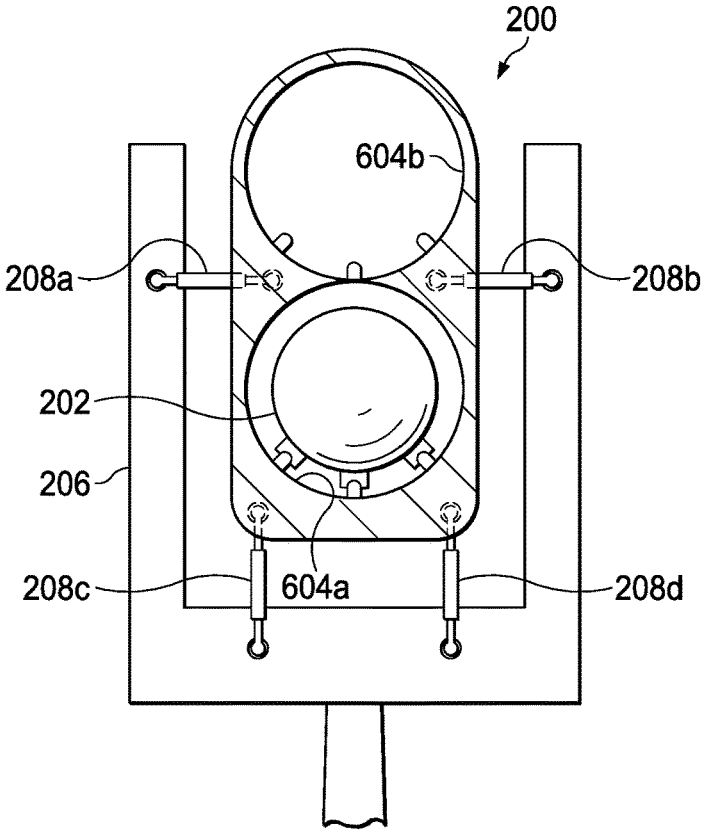
FIG. 6 illustrates the cross-section illustration of an alternate vacuum tube transportation system utilizing four actuators in accordance with an illustrative embodiment.

FIG. 6 illustrates the cross-section illustration of an alternate vacuum tube transportation system utilizing four actuators in accordance with an illustrative embodiment. In this embodiment the vacuum tubes 604*a*, 604*b* do not rely on torsional stiffness like tubes 204*a*, 204*b* in FIGS. 4 and 5. A four-actuator arrangement is used in this embodiment in which two vertical actuators 208*c*, 208*d* are positioned laterally beneath the tubes 604*a*, 604*b* to provide torsional stiffness to the tubes. This arrangement provides restraint to the tube structures 604*a*, 604*b* such that they can be prevented from rotating about their longitudinal axes.

It should be understood that the number of actuators need not be limited to three or four actuators. It may be advantageous to use a larger number of actuators to provide redundancy. The disadvantage of using more actuators is that a larger number of actuators results in a higher probability that one of them may malfunction.

The system can include sensors that can determine if an actuator is not working properly. If an actuator is not working properly, a quick disconnect system can remove that actuator from the system. Alternatively, the hydraulic system for that actuator can be unpressurized so that that actuator has little to no stiffness.

FIG. 7 illustrates a cross-section of ground in the vicinity of a support structure for the vacuum tube in accordance with an illustrative embodiment. In the example depicted, there is a layer of soil 720 under which is a layer of rock 722. Although only two layers are shown in FIG. 7 in reality there may be many more layers. Each layer has its own material properties, which include density, water content, and stiffness. As an earthquake wave travels through the various layers 720, 722, they can interact in a complex manner. The waves traveling through the layers will interact with the pad 212 in a particular way, causing it to move. The pad 212, column 207, support structure 206, and tubes 204 themselves all have mass and stiffness. Such interactions of the soil and the structure is the topic of a whole field of study termed soil-structure interaction.

A finite element model (FEM) 730 can be created with representations of the soil 720 and rock 722 layers, pad 212, column 207, support structure 206, tubes 204, and other components of the system, as shown in FIG. 7. The FEM 730 can reference the sensor displacement measurements over time, and can simulate the movement of the pad 212 and column 207, support structure 206, and tubes 204 attached to it and the rock 722 and soil 720 layers over the field of the model to a relatively high degree of accuracy. The model 730 depicted in FIG. 7 has a relatively coarse grid with several thousand degrees of freedom, but models with hundreds of thousands or even millions of degrees of freedom are routinely solved with current computing capacity. With the correct boundary conditions, these models can be used to predict the motions of the actuator support points as a function of time. Knowing those locations as function of time, the required actuator lengths as a function of time can be computed. These lengths as a function of time can be used to generate a signal to each actuator governing what length it should be as a function of time. The result of this system is a support system for the tubes that provides support while enabling the tubes to remain motionless during the duration of an earthquake event.

Sensors 710 can be placed on the tubes 204, on the support structure 206 near the support points of actuators 208, on the column 207, pad 212, and on the surface of the ground as shown in FIG. 7 to measure acceleration, velocity, and displacements in all three directions x, y, and z, and also rotations about those axes.

As an earthquake event is progressing, the output of these sensors 710 including displacement measurement information can be compared to the prediction of the FEM 730 for these quantities. This comparison can be used to assess whether or not the system is behaving as expected. Sensors 710 can also be located below the surface of the ground in the soil 720 and rock 722 layers, as shown in FIG. 7.

Placing sensors 710 under the surface of the ground provides a way to more completely tune the FEM 730 to reality, since data is now available throughout the volume being modeled. Although just a section is shown in FIG. 7, the field of sensors would cover the three-dimensional volume near the pad 212. These sensors can be linked by vertical tubes (not shown), which can carry the signals to the surface and also provide for any maintenance required of the sensors. The tubes can also be sensors themselves, and can be able to collect data over a continuum spanning the depth of the tube instead of being limited to discrete points, as shown in FIG. 7. Thus, some sensors need not be discrete, but some styles of sensors may be able to measure data continuously along the depth of the tube.

Having sensors deep under the surface of the earth may be useful in obtaining a more accurate prediction of the waves emanating from the epicenter of an earthquake event. For this reason, it can be advantageous to utilize sensors hundreds, or even thousands of feet below the earth's surface. However, not every support need have a deep sensor. For example, every other, or every fifth, or every tenth support location may be adequately covered by a sensor several hundred feet below the surface of the earth, and sensors several thousand feet below the surface of the earth may be spaced even further apart.

In the illustrative embodiment in FIG. 7 a volume under the support has been excavated and filled with a homogeneous material 740 such as sand or other material. The advantage of having a homogeneous material is that the physical properties of such a material, being constant and uniform, make it easier to predict the behavior more accurately. A more accurate prediction of the behavior implies a more accurate signal to the actuators, which results in less movement of the tube during an earthquake or other event.

The homogeneous material 740 can also be an engineered material that can provide structural damping to the system. This damping may reduce or eliminate high frequency content of the earthquake energy imparted to the mast. The material can also be designed to be nonlinear with deformation, such that it will limit or at least reduce the magnitudes of the displacements imparted to the mast.

If the material is an engineered material, it need not be homogeneous, but can be multilayered. What is important for an engineered volume is that the behavior can be accurately characterized. This eliminates the random nature of using soil and/or rock, since the properties of those natural structures cannot be controlled or as easily measured or characterized.

Being excavated and replaced with new material, there is also better access for installing a denser array of sensors. The finer grid of sensors shown in FIG. 7 makes it possible to more accurately measure the behavior of the system.

Figure 8:
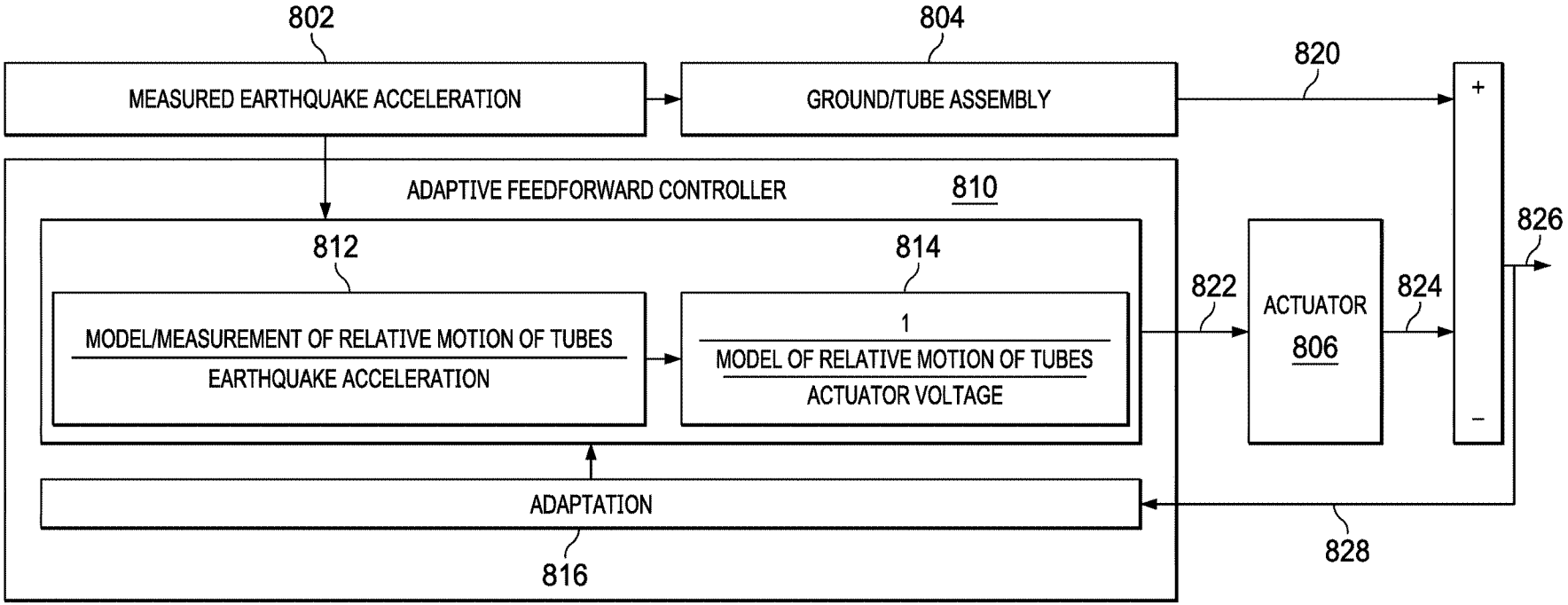
FIG. 8 illustrates an adaptive feedforward stabilization controller for a vacuum tube transportation system in accordance with illustrative embodiments.

FIG. 8 illustrates an adaptive feedforward stabilization controller for a vacuum tube transportation system in accordance with illustrative embodiments. A measured earthquake acceleration 802 which can affect a ground/tube assembly 804 to create relative displacement 820 of the vacuum tubes is fed to the adaptive feedforward controller 810. The controller 810 includes a model 812 of relative motion of the tubes relative to earthquake acceleration, which is used to calculate the proper actuator voltage relative to counteract the motion of the tube 814. The controller then sends the calculated voltage 822 to the actuator 806 in question to produce a cancelling, directionally-opposite displacement 824, thereby resulting in a reduced relative displacement 826 of the vacuum tubes and vehicles.

Relative displacement error 828 of the tubes based on the difference between the relative displacement predicted by the model 812 and the actual relative displacement 820 is fed back to the controller 810. This error feedback is then used for adaptation 816 in updating and refining the finite element model.

Figure 9:
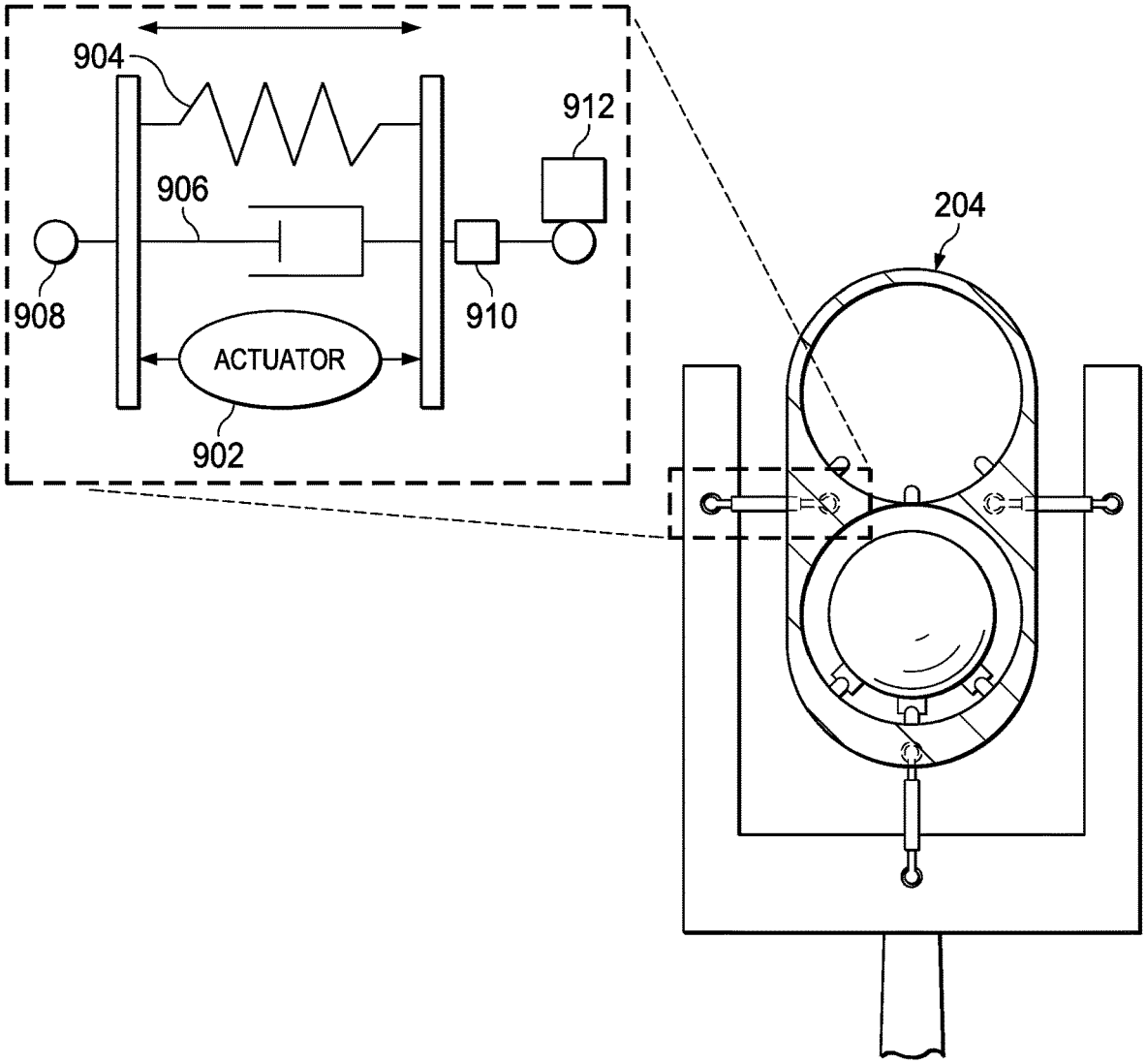
FIG. 9 illustrates an active isolation deflection controller in accordance with an illustrative embodiment.

If the ground sensors and/or the finite element model system fails for whatever reason, accelerometers on supports near the top of the mast can be used to provide the signal to the actuators. Accelerometers near each actuator support point on the mast can also be used. There is still a transfer function that provides the optimal amount of actuation for each actuator so that the tubes will not move. However, if that system is inoperative for whatever reason, the raw data from the accelerometers can provide an approximation to the correct value. For example, the horizontal actuators would be driven by the horizontal acceleration at the support points for those actuators, while the vertical actuator would be driven by the vertical acceleration at the support point for those actuators. An alternate solution mounts the accelerometers directly to the actuators such that the acceleration measured is always in the direction of the local axis of the actuator, as shown in FIG. 9. In this way, the geometry effects of changing angles between the actuators and the tubes is minimized.

If real-time inputs from accelerometers can be adequate to provide active control of the relative distances from the supports to the tubes such that the tubes can be held relatively motionless, the question arises as to whether it is worth the cost and complexity of using a finite element model to predict the behavior of the system so as to provide the correct signal to the actuators. The answer to this question is that the finite element model is able to predict the behavior of the system some time before it happens. It might be possible to predict the behavior of the whole route of supports many minutes in advance soon after an earthquake has been detected hundreds of miles away. It thus has an anticipatory characteristic that a real-time system cannot have. The advantage an anticipatory predictive system has is that it can accommodate lags in the actuation system. Actuators and other systems are not instantaneous. There will be a lag. If there is no predictive capacity, the correction will necessarily lag the event. However, if the finite element model can predict the response, it can also account for lags and time delays in the actuation system and correct for those. Thus, the response can be tailored to much more approximate the exact response required to keep the vacuum tubes as motionless as possible.

Another benefit of a finite element model is that a predictive system can assess whether or not the magnitude of the ground motions can overwhelm the capacity of the system to correct for those ground motions. Although it may be possible to design for a large magnitude earthquake, the system will have some value of maximum ground displacement, velocity, and acceleration that it can handle. If an earthquake is so large that it will exceed the capacity of the system, this valuable information can be conveyed to any vacuum tube vehicles that may be approaching the portion of the route that is affected by the earthquake event. A strong deceleration on the part of the vehicle may be less harmful than traveling through the greatly displaced tube at high speed.

This capability to assess the proper mitigating response to tube displacement also be helpful for non-earthquake events, such as a large explosion near the vacuum tube in the vicinity of the vehicle.

It may be advantageous that the sensors be designed to have a large range of accelerations that can be measured. They will be able to measure large accelerations that correspond to high energy events such as large earthquakes or large explosions near the vacuum tube. However, it is also advantageous that the sensors be capable of measuring very small accelerations. One reason for a high sensitivity to small accelerations is that small earthquakes can be used to fine-tune the predictive accuracy of the finite element model. Small earthquakes are occurring every day, and medium sized earthquakes occur often. If the waves from these earthquakes can be measured and correlated with the predicted waves from the finite element model, it will improve the accuracy of the method, thus improving the performance during larger earthquake events.

Very sensitive sensors can also be useful for surveillance of anything that may threaten the safety of the system. For example, extremely sensitive sensors can likely detect the presence of tunneling.

Testing can also be conducted by using small underground explosions using dynamite or some other explosive some safe distance away from the vacuum tubes and other structures nearby. The size and location of the explosions can be designed to approximate the various types of waves (surface waves vs. under the surface waves, shear waves vs. compression waves) that are generated as a result of an earthquake. This intermediate level of testing can be useful in approximating an event closer in magnitude to the design event for which the system is necessary to protect the safety of the passengers inside the vacuum tube vehicle.

Of course, during a large earthquake event, the output from the sensors would be recorded, so that data from that event can be used to further improve the model. It should be noted that the finite element model for each support would likely be different from other supports because the geometry and physical properties of the rock and soil will vary from support to support.

The equations of motion for any structural system is given as follows:

$$Ma+Cv+Ku=P \quad \text{(Eq. 1)}$$

Where M is mass, C is damping, K is stiffness, a is acceleration, v is velocity, u is displacement, and P is force.

In a finite element model, these quantities are discretized (or "collected") into discrete points. For example, in the finite element model 730 shown in FIG. 7, these quantities are defined at each of the corners of the elements. Using the finite element model, the displacements can be predicted as a function of time.

Support structures can communicate with each other. For example, if ground motion is such that the location of a support is permanently out of alignment, the lateral misalignment of adjacent supports can be adjusted so that the effect of the mismatch can be spread over multiple supports instead of just one support.

Figure 12:
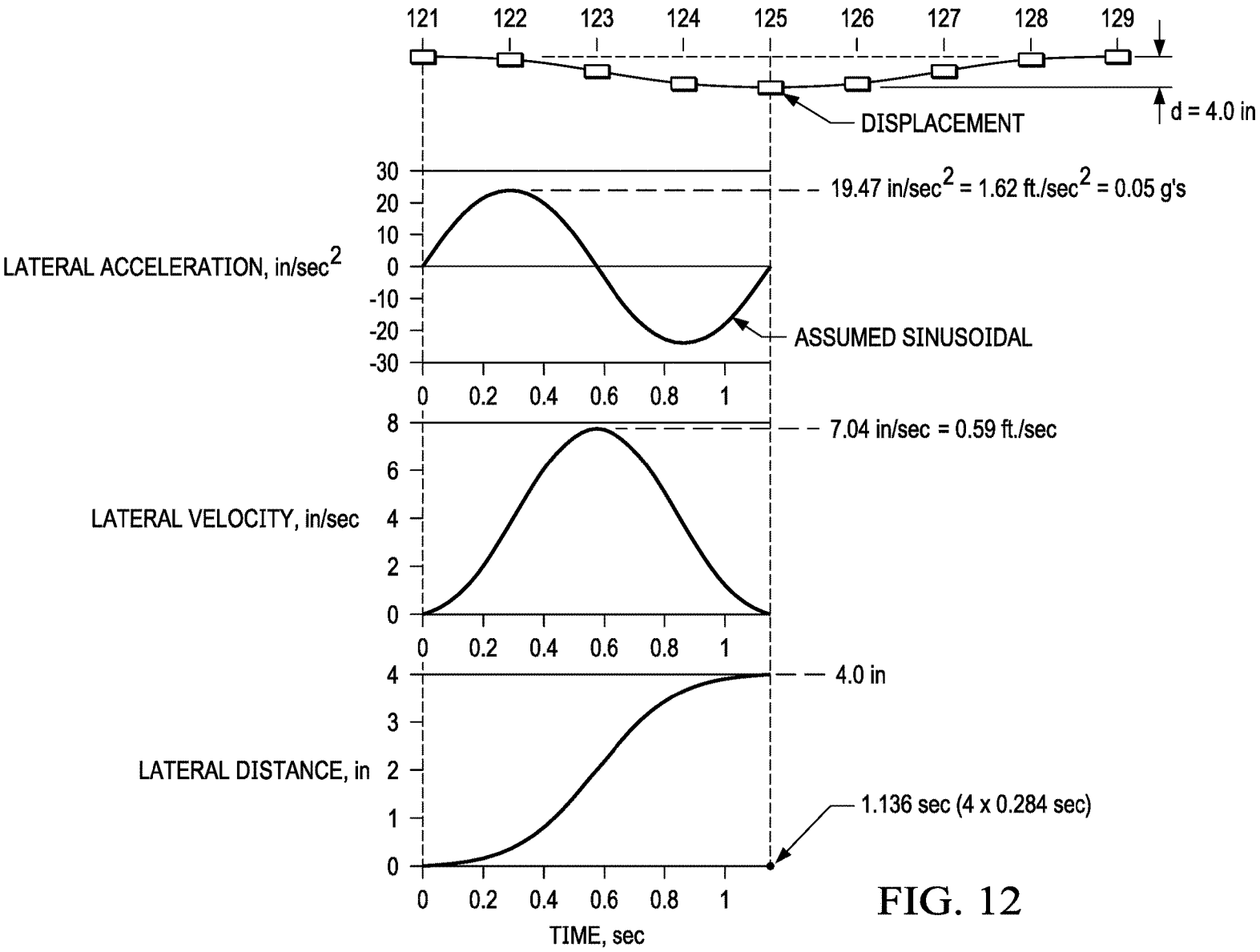
FIG. 12 illustrates a distribution of deflection control over a multiple support structures in response to a permanent misalignment of support structures in accordance with an illustrative embodiment.

FIG. 12 shows that if the misalignment is spread over four more spaces between the supports on either side longitudinally from the misaligned support (a four-fold increase in distance over which the misalignment is effective), the accelerations are reduced by a factor of sixteen. As shown in FIG. 12, this effect is spread over an additional three supports (or three spans between supports), thus lengthening the affected area by a factor of four. For this example, this solution reduces the acceleration to 0.05 g's, which is an acceptable level of acceleration for an emergency condition. This type of solution might require a FEM of a portion of the route, which can be run on a supercomputer remotely.

If ground motion at a support is extreme, it may exceed the capacity of the system. For example, the San Fernando earthquake of 1971 had a maximum displacement of 37.7 cm (14.8 inches). If the capacity of the system is less than 14.8 inches, it may be advantageous if adjacent supports adjust their position somewhat, so that the relative deflection between supports is reduced.

Figure 13:
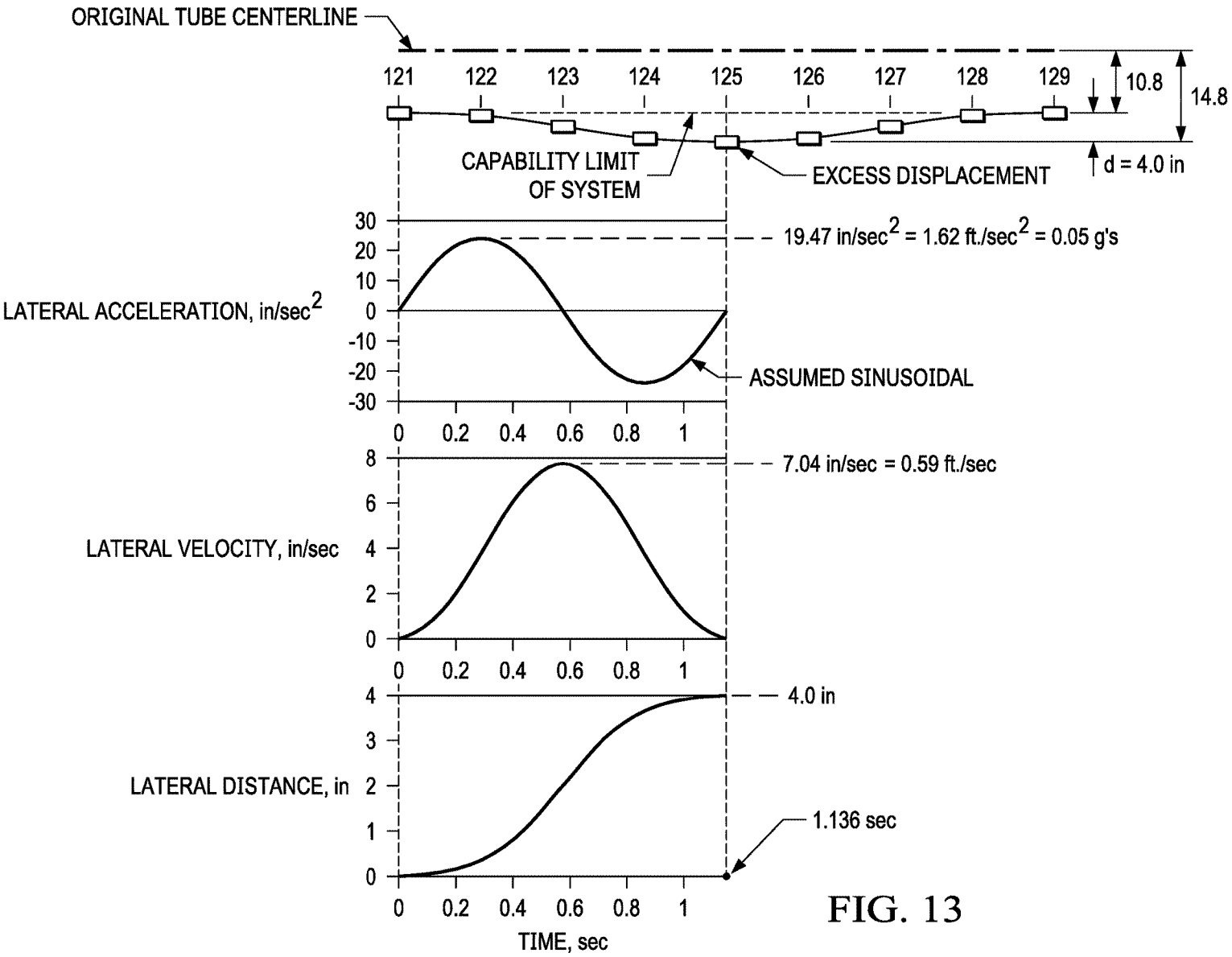
FIG. 13 illustrates a distribution of deflection control over a multiple support structures in response to an earthquake acceleration in accordance with an illustrative embodiment.

For example, if the limit of the actuation system is 10.8 inches, that would leave a shortfall of 4.0 inches. As shown in FIG. 13, the negative impact of that shortfall can be mitigated by spreading the effect over several supports in the same manner as shown in FIG. 12.

Communication between adjacent supports can be extended to the whole network of supports in the vacuum tube system. The data obtained from the whole network for an earthquake event can be used to determine aspects about the earthquake event that would be difficult or even impossible to obtain using the data from a single support structure. For example, the speed and direction of the various types of earthquake waves and their intensity may be easier to assess using a network of sensors spread over a longer length or even geographical area. This network of sensors would also benefit researchers in the field of earthquake engineering and other related fields. The vacuum tube train sensor network thus can collect a large amount of useful high-quality data. It may be that sensor capabilities for the vacuum tube network sensors may be enhanced beyond what is necessary for the vacuum tube network but possibly useful for the larger area of research.

Care should be taken in the routing of vacuum tube transport routes over earthquake fault lines. However, it might be unavoidable that routes will pass over fault lines. It is likely that the possible magnitudes of accelerations, velocities, and ground displacements would be greater at these locations compared to other locations along the route due to the increased probability that one of these locations could be the epicenter for an earthquake. For these locations, the capability of the actuator system can be designed to be greater than what is typically used on other portions of the route.

FIG. 9 illustrates an active isolation deflection controller in accordance with an illustrative embodiment. An alternate method to maintain the original position of the tube in the presence of an earthquake or other, low frequency seismic disturbance is to co-locate relative displacement sensors with each of the actuators. This can further include piezoresistive acceleration or force sensors enabling a specialized method of active isolation augmented with control of original position.

In this embodiment, actuators can be pneumatic, hydraulic or electrodynamic. Devices using electrically or magnetically active fluids can also be used in conjunction with or possibly in place of traditional actuators. Relative displacement sensors can be inductive, laser based, capacitive or resistive. Acceleration and/or force sensors should be capable of measuring a static acceleration or force.

In FIG. 9, the actuators from FIGS. 4-6 are replaced by an actuator 902 augmented by a passive spring 904, damper 906, and relative displacement sensor 908. A force transducer 910 is placed in series with the augmented actuator 902 near the tube and/or an accelerometer 912 is placed at the end of the actuator where it connects to the vacuum tubes 204. The accelerometer 912 is aligned so it measures axial accelerations.

Feedback control can be used to tailor the effective damping and spring constants of the augmented actuator shown in FIG. 9. A very low frequency isolator configured in this way can reject a portion of the earthquake seismic disturbance as well as other higher frequency excitations. For very low frequency disturbance and static position changes in the support structure, an additional, low frequency feedback loop can be closed using the actuator to minimize static displacement obtained by integrating the accelerometer twice. The effect of this loop would be to maintain the tube position in the presence of static or very low frequency disturbance. An additional or alternate approach would be to close a feedback loop that used the actuator to minimize very low frequency or static force as measured by the axial force transducer. This would also have the effect of maintaining the tube's position via inertia feedback provided by either of the static sensors.

Figure 14:
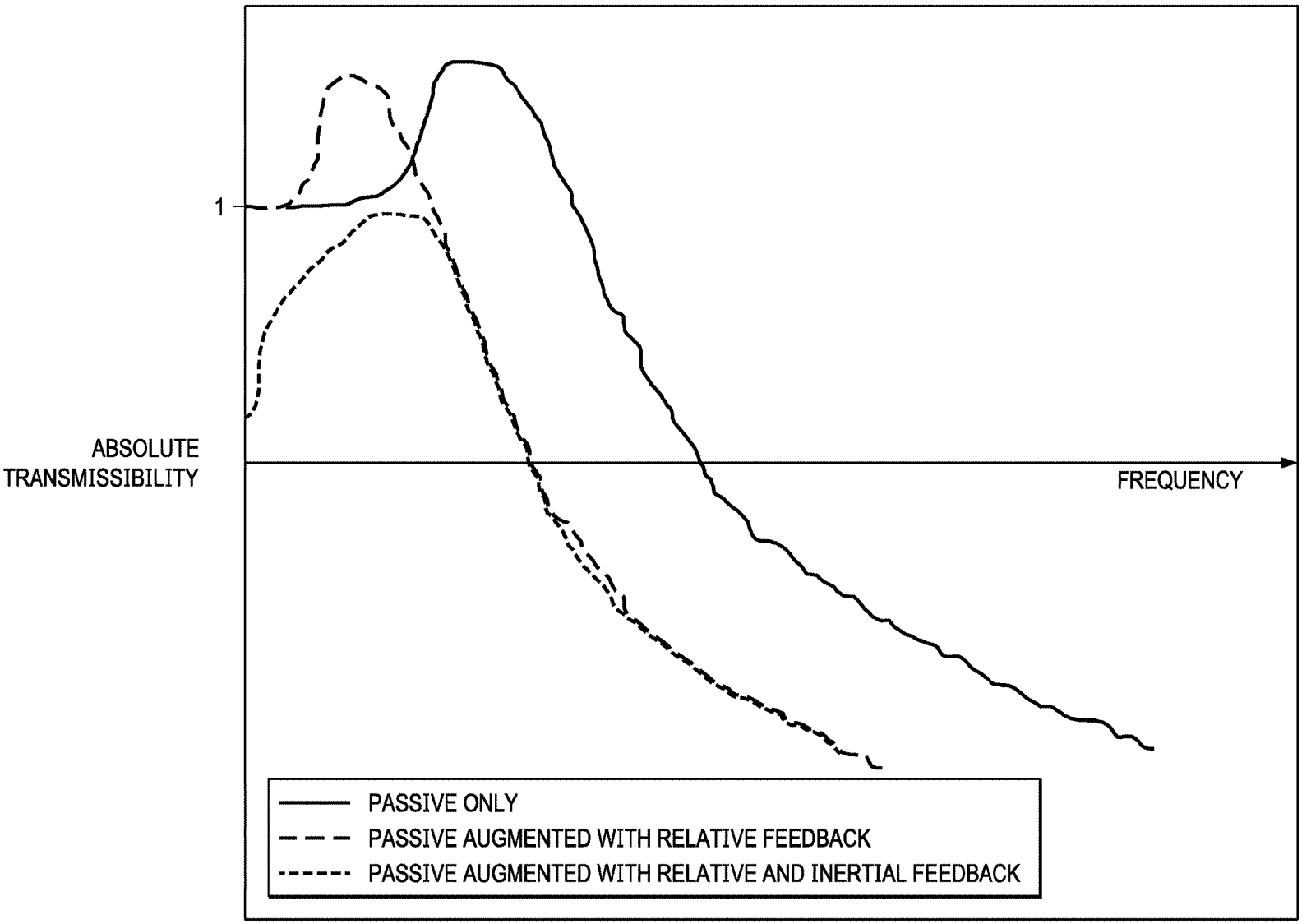
FIG. 14 illustrates the transmissibility across an augmented isolator that results after closing feedback loops in accordance with illustrative embodiments.

FIG. 14 illustrates the transmissibility across the augmented isolator that results after closing the feedback loops in accordance with illustrative embodiments. The solid (passive only) line is the classic transmissibility achieved with a spring and damper with no isolation at very low frequencies, amplification at resonance determined by the damper, and isolation at frequencies approximately 1.4 times the isolator resonance. The dashed (passive/relative) line shows the effect of feedback using the relative displacement sensor. This control loop can change the relative stiffness and damping to achieve a lower isolation frequency than might be possible with passive only. The dotted (passive/relative/inertial) line shows the effect of the very low frequency feedback loop minimizing either the static position or the static force. This loop would likely use a very low frequency integrator and could be designed to limit some of the amplification due to the isolation frequency resonance. At higher frequencies, it should behave like the system with relative feedback only. The minimal transmissibility at very low frequencies means the tube should stand still in the presence of a low frequency or static disturbance.

The actuators should have sufficient power to drive the displacements. Adequate reservoirs for the actuators can be provided. If electric power is used to change the lengths of the links, large capacitors may be used to store the power. Since the duration of earthquakes rarely exceeds several minutes, the capacitors need be sized only for that period of time. During the time between the primary earthquake and aftershocks, there would likely be time to repressurize the hydraulic reservoirs or recharge the capacitors.

Figure 10:
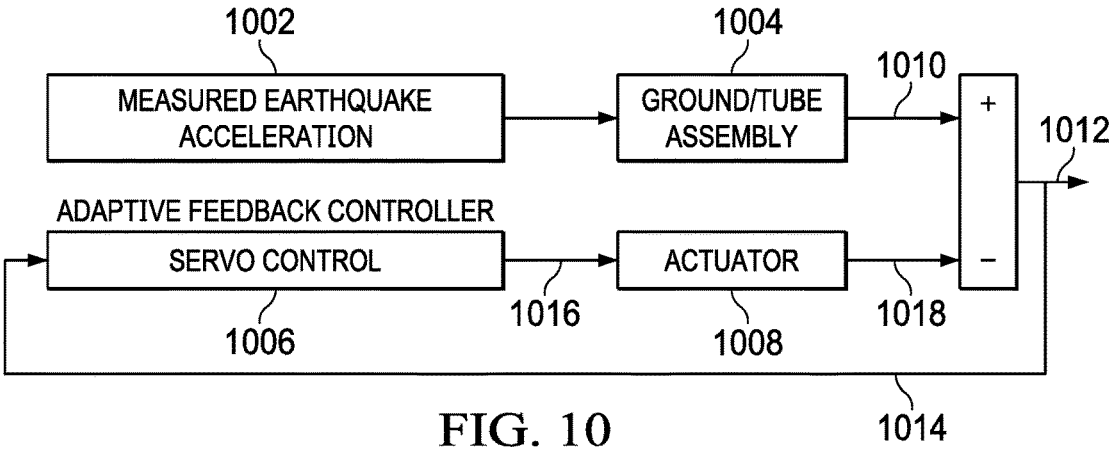
FIG. 10 illustrates an adaptive feedback controller in accordance with illustrative embodiments.

FIG. 10 illustrates an adaptive feedback controller in accordance with illustrative embodiments. A measured earthquake acceleration 1002 interacts with the ground/tube assembly 1004 to create relative displacement 1010 of the vacuum tubes. Relative and inertial displacement error data 1014 is fed by sensors to the feedback controller 1006, which generates a voltage 1016 to the actuator 1008. The actuator 1008 in turn produces cancelling, directionally-opposite displacement 1018 to create reduced displacement 1012 of the tubes.

Figure 15:
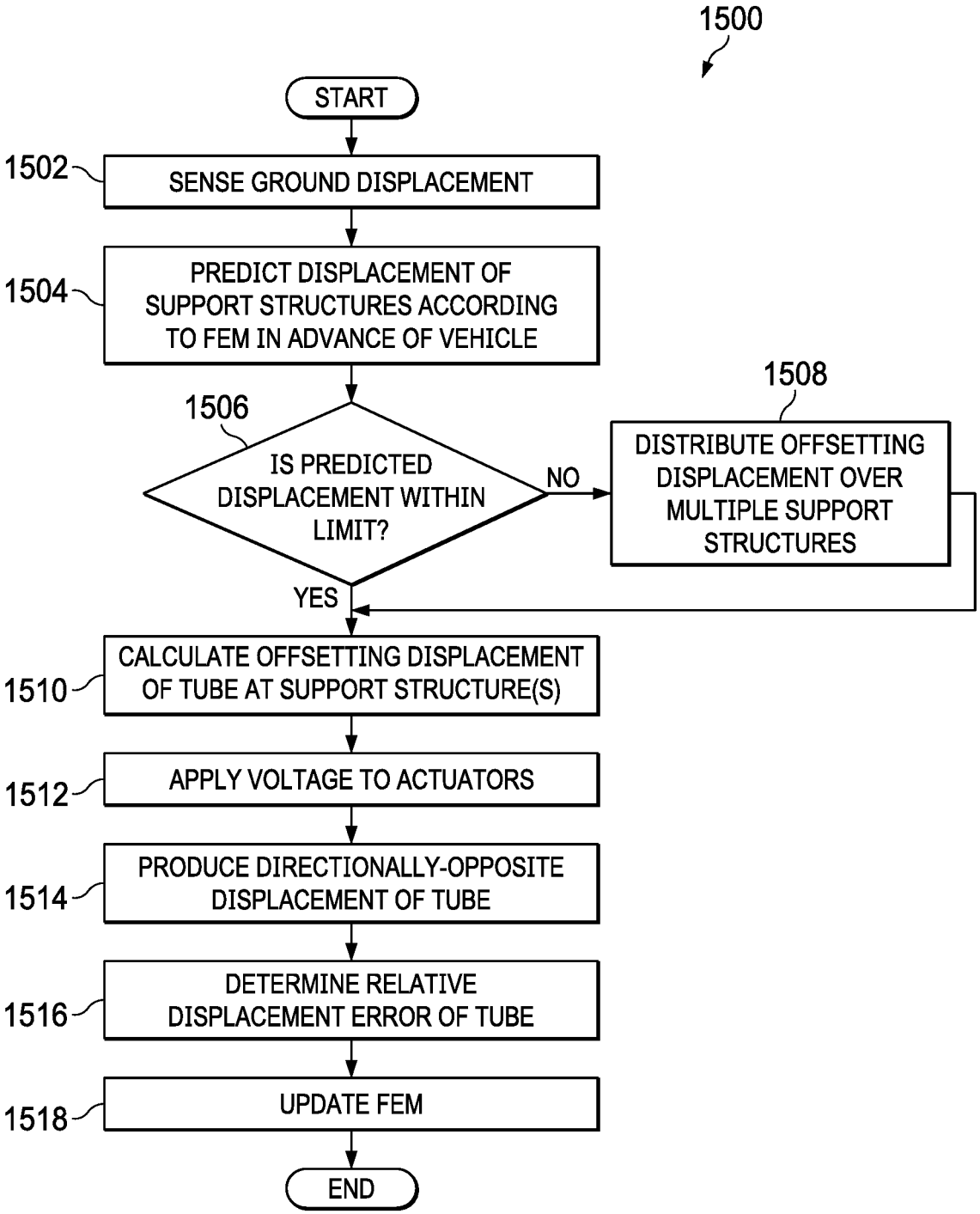
FIG. 15 is a process flow illustrative adaptive feedforward deflection control in accordance with an illustrative embodiment.

FIG. 15 is a process flow illustrative adaptive feedforward deflection control in accordance with an illustrative embodiment. Process 1500 begins by detecting ground displacement caused by an earthquake or other seismic event (step 1502). Based on the measured acceleration, a finite element model is used to predict displacement of support structures and the vacuum tube in advance of the vehicle's arrival at each location (step 1504). The system also determines if the predicted displacement is within the system's limit to produce completely cancelling, directionally-opposite displacement at a single support structure (step 1506).

If the predicted displacement is within limits, the system calculates the necessary offsetting displacement of the tube at the support structure (step 1510). If the predicted displacement is beyond system limits, the offsetting displacement is first calculated for distribution over multiple support structures before calculating the offsetting displacement at each support (step 1508).

After the necessary cancelling displacement is determined, the controller applies the appropriate voltage to the actuators (step 1512), and the actuators produce directionally-opposite displacement of the tube (step 1514).

Relative displacement error of the tube is determined according to the difference between predicted and actual displacement of the tube in response to the earthquake acceleration (step 1516). The error data is fed back to the controller and used to update the finite element model (step 1518).

Figure 16:
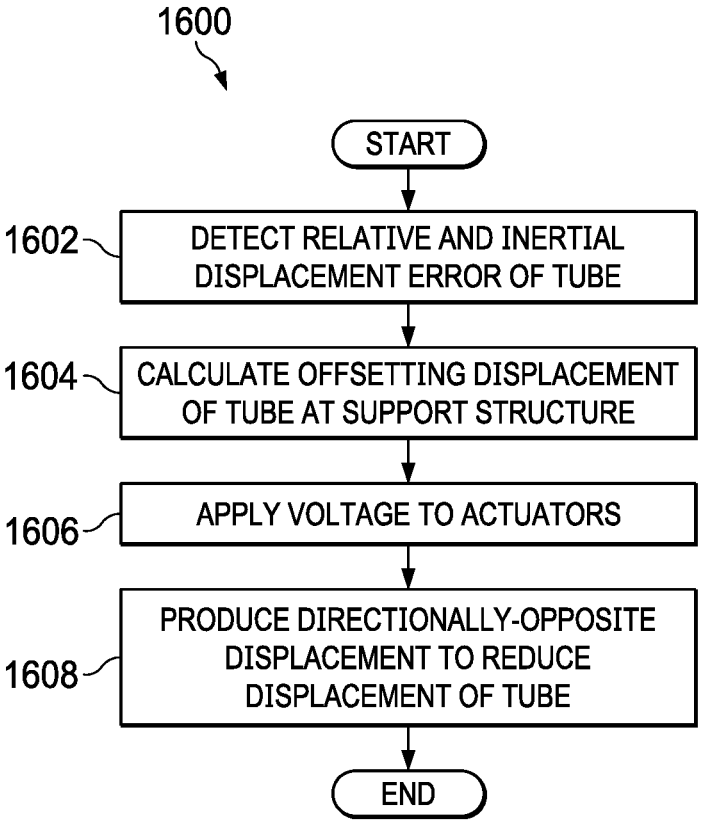
FIG. 16 is a process flow illustrative adaptive feedback deflection control in accordance with an illustrative embodiment.

FIG. 16 is a process flow illustrative adaptive feedback deflection control in accordance with an illustrative embodiment. Process 1600 begins when sensors detect relative and inertial displacement error of the tube in response to an earthquake acceleration or other seismic event (step 1602). The displacement data is used to calculate the necessary offsetting, directionally-opposite displacement of the tube (step 1604).

Appropriate voltage is then applied to the actuators (step 1606), which produce directionally-opposite displacement to reduce relative displacement of the tube (step 1608).

Figure 17:
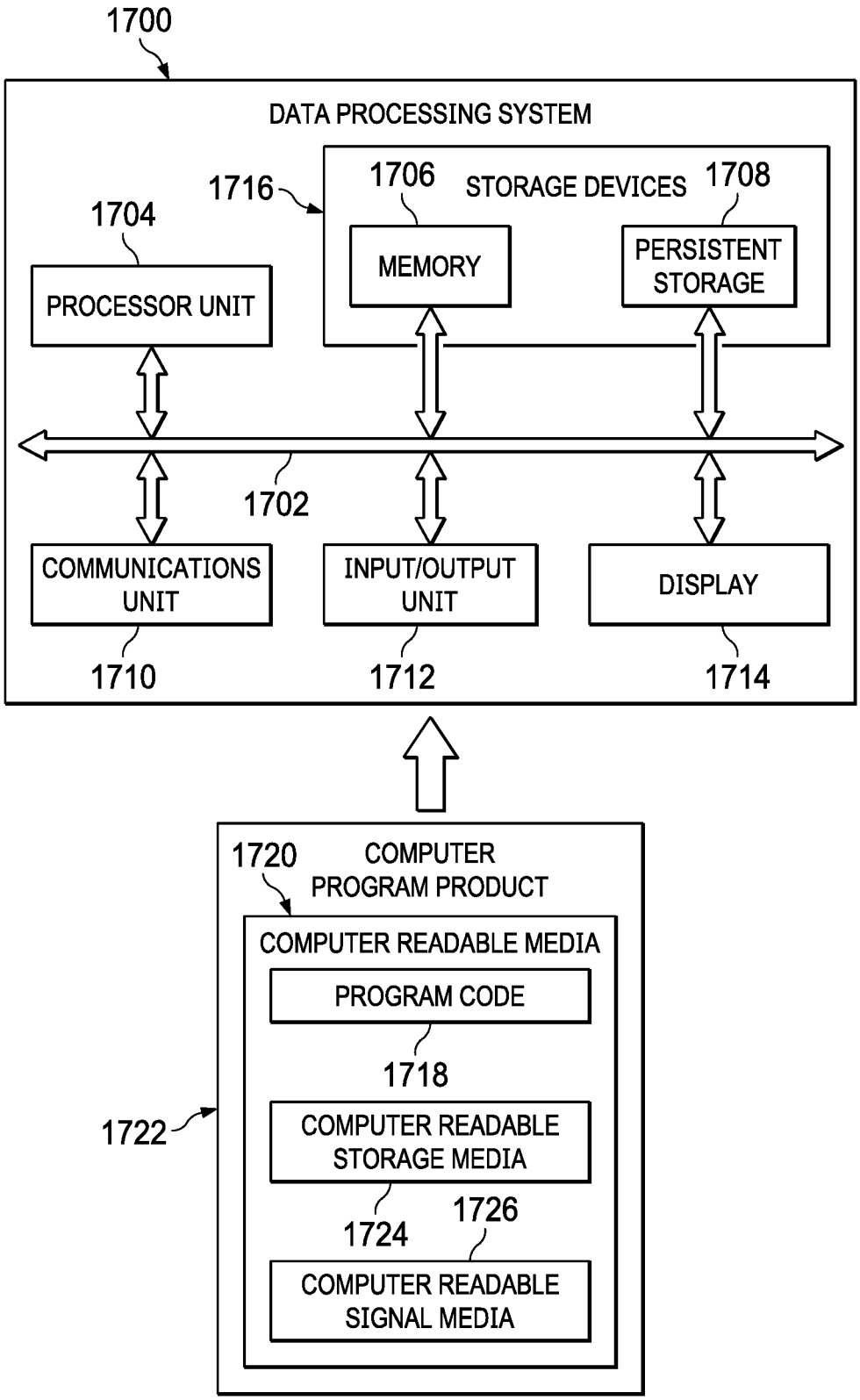
FIG. 17 is an illustration of a data processing system in accordance with an illustrative embodiment.

Turning now to FIG. 17, an illustration of a data processing system is depicted in accordance with an illustrative embodiment. Data processing system 1700 may be used to implement controller 161 in FIG. 1. In this illustrative example, data processing system 1700 includes communications framework 1702, which provides communications between processor unit 1704, memory 1706, persistent storage 1708, communications unit 1710, input/output (I/O) unit 1712, and display 1714. In this example, communications framework 1702 may take the form of a bus system.

Processor unit 1704 serves to execute instructions for software that may be loaded into memory 1706. Processor unit 1704 may be a number of processors, a multi-processor core, or some other type of processor, depending on the particular implementation.

Memory 1706 and persistent storage 1708 are examples of storage devices 1716. A storage device is any piece of hardware that is capable of storing information, such as, for example, without limitation, data, program code in functional form, and/or other suitable information either on a temporary basis and/or a permanent basis. Storage devices 1716 may also be referred to as computer readable storage devices in these illustrative examples. Memory 1706, in these examples, may be, for example, a random access memory or any other suitable volatile or non-volatile storage device. Persistent storage 1708 may take various forms, depending on the particular implementation.

For example, persistent storage 1708 may contain one or more components or devices. For example, persistent storage 1708 may be a hard drive, a flash memory, a rewritable optical disk, a rewritable magnetic tape, or some combination of the above. The media used by persistent storage 1708 also may be removable. For example, a removable hard drive may be used for persistent storage 1708.

Communications unit 1710, in these illustrative examples, provides for communications with other data processing systems or devices. In these illustrative examples, communications unit 1710 is a network interface card.

Input/output unit 1712 allows for input and output of data with other devices that may be connected to data processing system 1700. For example, input/output unit 1712 may provide a connection for user input through a keyboard, a mouse, and/or some other suitable input device. Further, input/output unit 1712 may send output to a printer. Display 1714 provides a mechanism to display information to a user.

Instructions for the operating system, applications, and/or programs may be located in storage devices 1716, which are in communication with processor unit 1704 through communications framework 1702. The processes of the different embodiments may be performed by processor unit 1704 using computer-implemented instructions, which may be located in a memory, such as memory 1706.

These instructions are referred to as program code, computer usable program code, or computer readable program code that may be read and executed by a processor in processor unit 1704. The program code in the different embodiments may be embodied on different physical or computer readable storage media, such as memory 1706 or persistent storage 1708.

Program code 1718 is located in a functional form on computer readable media 1720 that is selectively removable and may be loaded onto or transferred to data processing system 1700 for execution by processor unit 1704. Program code 1718 and computer readable media 1720 form computer program product 1722 in these illustrative examples. In one example, computer readable media 1720 may be computer readable storage media 1724 or computer readable signal media 1726.

In these illustrative examples, computer readable storage media 1724 is a physical or tangible storage device used to store program code 1718 rather than a medium that propagates or transmits program code 1718.

Alternatively, program code 1718 may be transferred to data processing system 1700 using computer readable signal media 1726. Computer readable signal media 1726 may be, for example, a propagated data signal containing program code 1718. For example, computer readable signal media 1726 may be an electromagnetic signal, an optical signal, and/or any other suitable type of signal. These signals may be transmitted over communications links, such as wireless communications links, optical fiber cable, coaxial cable, a wire, and/or any other suitable type of communications link.

The different components illustrated for data processing system 1700 are not meant to provide architectural limitations to the manner in which different embodiments may be implemented. The different illustrative embodiments may be implemented in a data processing system including components in addition to and/or in place of those illustrated for data processing system 1700. Other components shown in FIG. 17 can be varied from the illustrative examples shown. The different embodiments may be implemented using any hardware device or system capable of running program code 1718.

Figure 18:
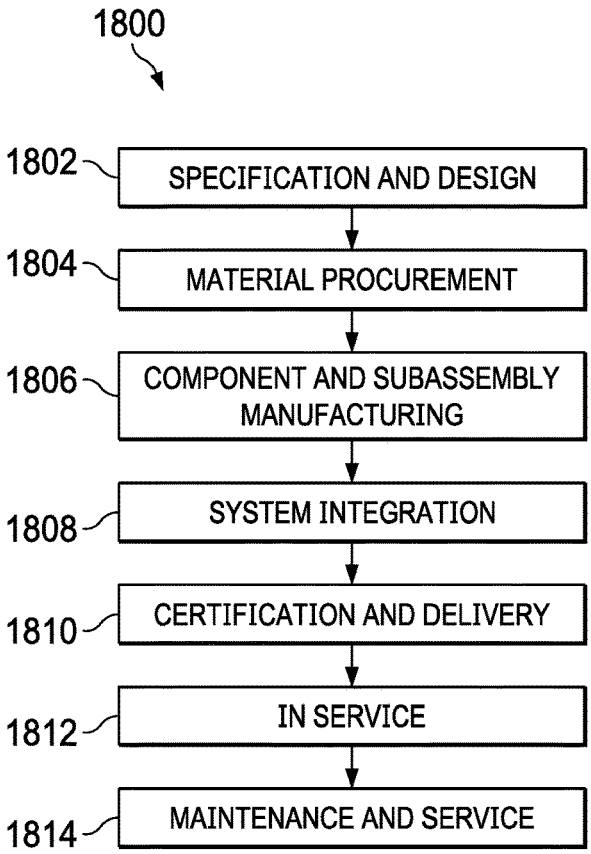
FIG. 18 is an illustration of a vehicle manufacturing and service method in accordance with an illustrative embodiment.
Figure 19:
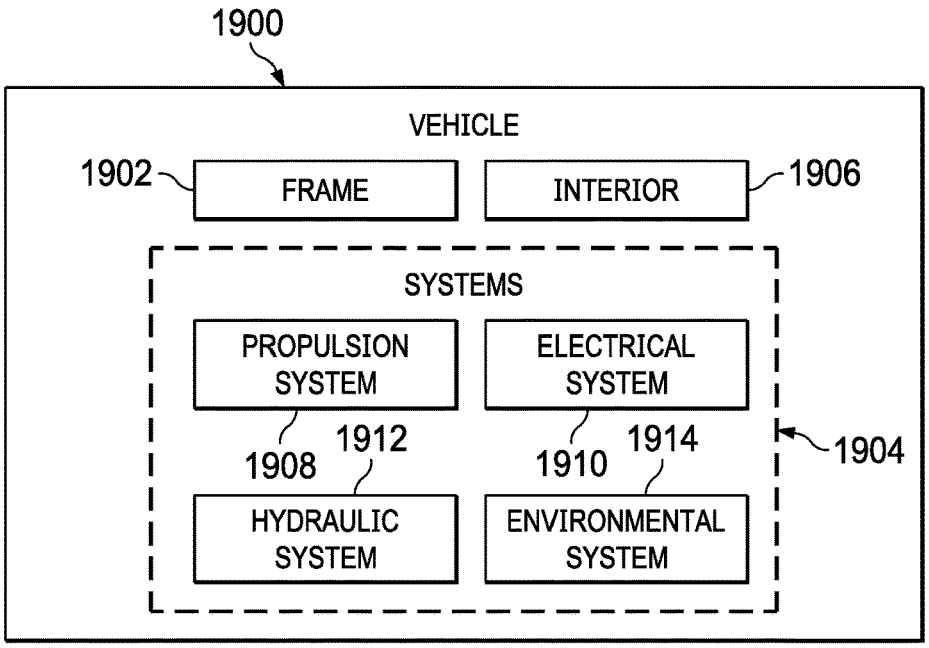
FIG. 19 is an illustration of a vehicle in which an illustrative embodiment may be implemented.

Illustrative embodiments of the disclosure may be described in the context of vehicle manufacturing and service method 1800 as shown in FIG. 18 and vehicle 1900 as shown in FIG. 19. Turning first to FIG. 18, an illustration of a vehicle manufacturing and service method is depicted in accordance with an illustrative embodiment. During preproduction, vehicle manufacturing and service method 1800 may include specification and design 1802 of vehicle 1900 in FIG. 19 and material procurement 1804.

During production, component and subassembly manufacturing 1806 and system integration 1808 of vehicle 1900 takes place. Thereafter, vehicle 1900 may go through certification and delivery 1810 in order to be placed in service 1812. While in service 1812 by a customer, vehicle 1900 is scheduled for routine maintenance and service 1814, which may include modification, reconfiguration, refurbishment, and other maintenance or service.

Each of the processes of vehicle manufacturing and service method 1800 may be performed or carried out by a system integrator, a third party, and/or an operator. In these examples, the operator may be a customer. For the purposes of this description, a system integrator may include, without limitation, any number of vehicle manufacturers and major-system subcontractors; a third party may include, without limitation, any number of vendors, subcontractors, and suppliers; and an operator may be a transportation company, a leasing company, a military entity, a service organization, and so on.

With reference now to FIG. 19, an illustration of a vehicle is depicted in which an illustrative embodiment may be implemented. In this example, vehicle 1900 is produced by vehicle manufacturing and service method 1800 in FIG. 18 and may include frame 1902 with plurality of systems 1904 and interior 1906. Examples of systems 1904 include one or more of propulsion system 1908, electrical system 1910, hydraulic system 1912, and environmental system 1914. Any number of other systems may be included.

Apparatuses and methods embodied herein may be employed during at least one of the stages of vehicle manufacturing and service method 1800 in FIG. 18. In one illustrative example, components or subassemblies produced in component and subassembly manufacturing 1806 in FIG. 18 may be fabricated or manufactured in a manner similar to components or subassemblies produced while vehicle 1900 is in service 1812 in FIG. 18.

As used herein, the phrase "a number" means one or more. The phrase "at least one of", when used with a list of items, means different combinations of one or more of the listed items may be used, and only one of each item in the list may be needed. In other words, "at least one of" means any combination of items and number of items may be used from the list, but not all of the items in the list are required. The item may be a particular object, a thing, or a category.

The description of the different illustrative embodiments has been presented for purposes of illustration and description, and is not intended to be exhaustive or limited to the embodiments in the form disclosed. Many modifications and variations will be apparent to those of ordinary skill in the art.

Further, different illustrative embodiments may provide different features as compared to other illustrative embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. A stabilization apparatus, comprising:

a number of support structures configured to support a tube that defines an interior enclosure through which a vehicle can travel, wherein the support structures are connected to the ground;

a number of actuators coupled to the support structures and connectable to the tube, being configured to displace the tube relative to the support structures;

a number of sensors configured to sense directional displacement of the number of support structures; and a number of controllers in communication with the number of sensors and number of actuators, wherein responsive to a determination of a sensed displacement by at least one sensor, the controllers are configured to cause the actuators to displace the tubes to counter the sensed displacement of the support structures by producing a directionally-opposite displacement of the tube relative to the support structures.

2. The apparatus of claim 1, wherein the controllers comprise feedforward controllers designed to operate according a self-tuning finite element model (FEM) that predicts displacement of the support structures in advance of arrival of the vehicle at the support structures along a route.

3. The apparatus of claim 1, wherein the controllers comprise adaptive feedback controllers designed to provide active isolation in response to displacement of the support structures.

4. The apparatus of claim 1, wherein the actuators are:

hydraulic;

pneumatic; or electrodynamic.

5. The apparatus of claim 1, wherein the actuators comprise at least one horizontal actuator positioned on either side of the tube and at least one vertical actuator positioned beneath the tube.

6. The apparatus of claim 5, further comprising at least two vertical actuators positioned laterally beneath the tube to provide torsional stiffness to the tube.

7. The apparatus of claim 1, wherein the sensors are located at least:

on the support structures;

on the actuators;

on the tube;

on the ground;

below ground.

8. The apparatus of claim 1, further comprising a number of accelerometers attached to the actuators, wherein the accelerometers are configured to measure acceleration along local axes of the actuators.

9. The apparatus of claim 1, further comprising a homogeneous material filling an excavated volume of ground under at least one support structure, wherein the homogeneous material is nonlinear with deformation to provide structural damping.

10. A transportation system comprising:

a tube defining an interior enclosure through which a vehicle can travel;

a number of support structures configured to support the tube, wherein the support structures are connected to the ground;

a number of actuators coupling the tube to the support structures, wherein the actuators are configured to displace the tube relative to the support structure;

a number of sensors configured to sense directional displacement of the number of support structures; and a number of controllers in communication with the number of sensors and number of actuators, wherein responsive to a determination of a sensed displacement by at least one sensor the controllers are configured to cause the actuators to displace the tube to counter the sensed displacement of the support structures by producing a directionally-opposite displacement of the tube relative to the support structures.

11. The system of claim 10, wherein the controllers comprise feedforward controllers designed to operate according a self-tuning finite element model (FEM) that predicts displacement of the support structures in advance of arrival of the vehicle at the support structures along a route.

12. The system of claim 10, wherein the controllers comprise adaptive feedback controllers designed to provide active isolation in response to displacement of the support structures.

13. The system of claim 10, wherein the vehicle is a magnetic levitation vehicle.

14. The system of claim 10, further comprising a homogeneous material filling an excavated volume of ground under at least one support structure, wherein the homogeneous material is nonlinear with deformation to provide structural damping.

15. A method of neutralizing deflection in a transportation system, the method comprising:

connecting a number of support structures to the ground;

coupling a tube to the support structures via a number of actuators, wherein the tube defines an interior enclosure through which a vehicle can travel;

sensing, utilizing a number of sensors, directional displacement of the support structures; and controlling the actuators to displace the tube to counter the sensed displacement of the support structures by producing a directionally-opposite displacement of the tube relative to the support structures.

16. The method of claim 15, further comprising determining displacement of the support structures according a self-tuning finite element model (FEM) that predicts displacement of the support structures in advance of arrival of the vehicle at the support structures along a route.

17. The method of claim 16, wherein the FEM is constructed from sensor data provided by sensors located at least on the support structures, on the actuators, on the tube, on the ground, or below ground, and wherein the FEM is updated over time as operational displacement data accumulates.

18. The method of claim 16, further comprising, if a predicted displacement of a first support structure exceeds a maximum cancelling displacement of the actuators, determining the difference between the predicted displacement and the maximum cancelling displacement and distributing the difference across a number of additional supporting structures preceding the first support structure along the route.

19. The method of claim 15, further comprising controlling the actuators through adaptive feedback to provide active isolation in response to displacement of the support structures.

20. The method of claim 15, further comprising filling an excavated volume of ground under at least one support structure with a homogeneous material, wherein the homogeneous material is nonlinear with deformation to provide structural damping.

* * * * *